US005942096A

United States Patent [19]

Ruzicka et al.

[11] Patent Number: 5,942,096

[45] Date of Patent: Aug. 24, 1999

[54] METHOD AND APPARATUS FOR ELECTRO-DEPOSITING A METAL OR ALLOY COATING ONTO ONE OR BOTH SIDES OF A METAL STRIP

[75] Inventors: Franz Ruzicka, Wien; Gerald Maresch, Mödling, both of Austria; Ortwin Noll, Straszenhaus; Werner Schüler, Isenburg, both of German Dem. Rep.

[73] Assignee: Andritz-Patentverwaltungs-Gesellschaft, Graz, Austria

[21] Appl. No.: 08/843,636

[22] Filed: Apr. 10, 1997

[30] Foreign Application Priority Data

Apr. 15, 1996 [AU] Australia ..... 676/96

[51] Int. Cl.[6] ..... C25D 7/06; C25D 17/00; C25B 11/00; C25B 11/04

[52] U.S. Cl. ..... 205/138; 204/206; 204/290 R; 204/290 F; 204/292; 204/293

[58] Field of Search ..... 205/130, 138; 204/206, 292, 293, 290 R, 290 F

[56] References Cited

U.S. PATENT DOCUMENTS

| | | | |
|---|---|---|---|
| 3,975,242 | 8/1976 | Matsuda et al. | 204/206 |
| 4,267,024 | 5/1981 | Weiskopf | 205/130 |
| 4,310,403 | 1/1982 | Nitto et al. | 205/138 |
| 4,397,727 | 8/1983 | Degen | 204/206 |
| 4,469,565 | 9/1984 | Hampel | 204/206 |
| 4,964,965 | 10/1990 | Nakatsugawa | 204/206 |

FOREIGN PATENT DOCUMENTS 3209451 9/1982 Germany .

*Primary Examiner*—Kathryn Gorgos
*Assistant Examiner*—Edna Wong
*Attorney, Agent, or Firm*—Roylance, Abrams, Berdo & Goodman, L.L.P.

[57] ABSTRACT

An apparatus and method for electro-depositing of a material on at least one side of a metal strip. The apparatus includes at least one casing having a first container section adapted to store under pressure a liquid including the material, a second container adapted to receive a portion of the liquid from the first container section, and a panel. The panel includes an active portion that is electrically polarized at a first polarity, at least one first outlet through which the liquid stored under pressure in the first container section is output in a direction toward the metal strip when the metal strip is conveyed past the panel, and at least one second outlet through which the liquid stored in the second container section is output in a direction toward the conveyed metal strip. The first outlet can be a slit which extends at an angle with respect to the direction in which the strip is conveyed, and the second outlets can be slits which extend traverse to the direction in which the strip is conveyed. The apparatus includes guiding rollers which guide the strip past the panels of the casings, which can be configured in pairs to coat both sides of the strip, or singularly to coat only one side of the strip. The initial guiding roller is electrically polarized at a polarity opposite to the polarity at which the panels are polarized to thus polarize the strip at that opposite polarity.

29 Claims, 5 Drawing Sheets

METHOD AND APPARATUS FOR ELECTRO-DEPOSITING A METAL OR ALLOY COATING ONTO ONE OR BOTH SIDES OF A METAL STRIP

BACKGROUND OF THE INVENTION

1. Field of the Invention

The present invention relates to a method and apparatus for electro-depositing a metal or metal alloy coating on at least one side of a metal strip by using at least one electrically polarized panel having a slit and a plurality of openings through which electrolytic liquid is ejected onto a corresponding side of the metal strip being coated.

2. Description of the Related Art

A conventional electro-deposition apparatus is described, for example, in German Patent Appln. No. 3209451, and includes an electrically polarized panel that includes a slit for emitting electrolytic liquid. The panel is typically made of a material that is insoluble in the electrolytic liquid.

The metal strip to be coated is conveyed in front of the slit which extends lengthwise in the direction along which the strip is conveyed. Typically, the panel is arranged so that the slit extends lengthwise in a vertical direction and the metal strip is conveyed in a vertical direction past the slit. A large amount of electrolytic liquid can flow through the entire slit at one time and thus completely fill the gap between the metal strip and panel before draining off to the sides of the panel.

However, due to the high pressure at which the electrolytic liquid is emitted from the slit, the center of the strip is usually forced away from the panel along the entire length of the strip. On the contrary, due to the hydraulic paradox phenomenon, the flow of the electrolytic liquid along the strip edges causes the strip to be drawn towards the panel. Due to these problems, it is difficult for the conventional apparatus to produce a uniform coating on the metal strip.

That is, because the strip is not evenly conveyed past the panel, the thickness of the coating deposited on the strip varies substantially over the width of the strip. Typically, the coating is thicker along the outside edges of the strip than along the center of the strip.

SUMMARY OF THE INVENTION

An object of the present invention, therefore, is to provide an electro-plating apparatus and method that is capable of distributing the coating more evenly over the entire thickness of the metal strip, while also reducing the amount of electrolytic liquid that is wasted during the coating process. In order to achieve this object, the apparatus comprises a polarized panel that is integral with or connected to a casing having a first sector which contains pressurized electrolytic liquid and a second sector which contains unpressurized electrolytic liquid.

The polarized panel includes an outlet slit that extends lengthwise in an essentially vertical direction and is in communication with the first sector so that the pressurized electrolytic liquid stored in the first sector can be ejected through the slit. The polarized panel further includes at least one outlet that is in communication with the second sector and through which the unpressurized electrolytic liquid is emitted. The slit and outlet(s) are configured so that the pressurized and unpressurized liquids are emitted into a gap between the strip to be coated and the polarized panel when the strip is conveyed in front of the polarized panel. Due to the additional outlet(s), the flow of the electrolytic liquid between strip and polarized panel is greatly improved so that a variation in coating thickness across the entire width of the strip and along the entire length of a strip having a width of 1500 mm can be within the range of ±7% without the use of any tension leveling device to adjust the tension in the strip as it is conveyed in front of the panel. It is noted, furthermore, that in the conventional apparatus, the thickness of the coating along the width and length of the strip will vary by about ±10% or more even when a tension leveling device is used. Accordingly, the present invention provides an electro-deposition apparatus having a construction that is less complicated than that of the convention apparatus, and which also achieves better results than the conventional apparatus.

The present invention further includes an adjustable control element which controls the pressure of the pressurized electrolytic liquid by allowing some of the electrolytic liquid to flow into the unpressurized second sector. In addition, the essentially vertical outlet slit can be tapered so that its width narrows towards the bottom of the panel to compensate for the difference in pressure of the electrolytic liquid over the height of the panel. Furthermore, instead of being a continuous slit, the outlet slit can include several slit-shaped openings with a cross-link being disposed between each opening. In this arrangement, the pressure of the electrolytic liquid flowing out of the openings can produce a pressure and suction effect whose opposing forces neutralize each other.

The slit-shaped openings of the outlet slit can also be placed in an offset arrangement, thus providing a more consistent flow of electrolytic liquid which allows the strip to be guided more evenly in front of the panel. As a result, the coating is distributed more evenly. In addition, at least one, preferably horizontal slit through which unpressurized liquid can be emitted is provided in the panel at a location above or below the essentially vertical slit. The electrolytic liquid flowing out of these additional outlet slits form a liquid curtain which prevents air from being sucked into the gap between the panel and the strip, thereby improving the flow of liquid into the gap between the panel and strip.

The flow of electrolytic liquid in the gap can further be stabilized if additional outlets through which unpressurized electrolytic liquid flows are provided in the panel along the sides of the essentially vertical slit. Furthermore, a horizontal or essentially horizontal rail can be provided at the lower end of the polarized panel below the slit and openings to prevent the liquid from draining down in the direction in which the strip is conveyed.

The entire polarized panel and, in particular, the active area of the panel can be made of a material such as lead, a lead alloy, platinised titanium or iridium oxide-coated titanium, which is insoluble in the electrolytic liquid. In this event, although it is necessary to supplement the metal concentration in the electrolytic liquid regularly, the need to replace the panel due to deterioration by the liquid is reduced. The non-active areas of the panel and, if necessary, the casing, can be made of titanium or non-conducting, acid-resistant plastic.

The panel or at least its active area can be divided into a plurality of sections (e.g., three sections) which are disposed adjacent to each other in a direction transverse to the direction in which the strip is conveyed. In this arrangement, the essentially vertical outlet slit and the additional outlets through which the unpressurized liquid flows are located in the middle section. Furthermore, in order to maintain a uniform efficiency at which the metal is deposited over the entire width of the changed panel in spite of the presence of the vertical outlet slit in the middle section, the middle section can be made longer than the side sections in the strip conveying direction. That is, it is preferable that all of the sections have the same or substantially the same shape and area. Hence, the surface area that is missing in the middle panel due to the presence of the outlet slit and the other outlets is compensated for by this extra length.

In addition, spacing rollers can be disposed at the upper and/or lower ends of the panel to prevent the strip from accidentally contacting the panel and to thus assure that the exact clearance between the panel and strip is maintained. Furthermore, the panel could be suspended using an adjustable mechanism so that the space between the strip and the panel can be aligned and adjusted (e.g., in accordance with the shape and/or size of the strip) even during the electro-deposition process. In this case, the adjustable mechanism can be a hydraulic, pneumatic or electrical type.

BRIEF DESCRIPTION OF THE DRAWINGS

The present invention, as well as other advantages and features thereof, are explained in more detail in the following description on the basis of the enclosed drawings, in which.

DETAILED DESCRIPTION OF THE PREFERRED EMBODIMENTS

Figure 1:
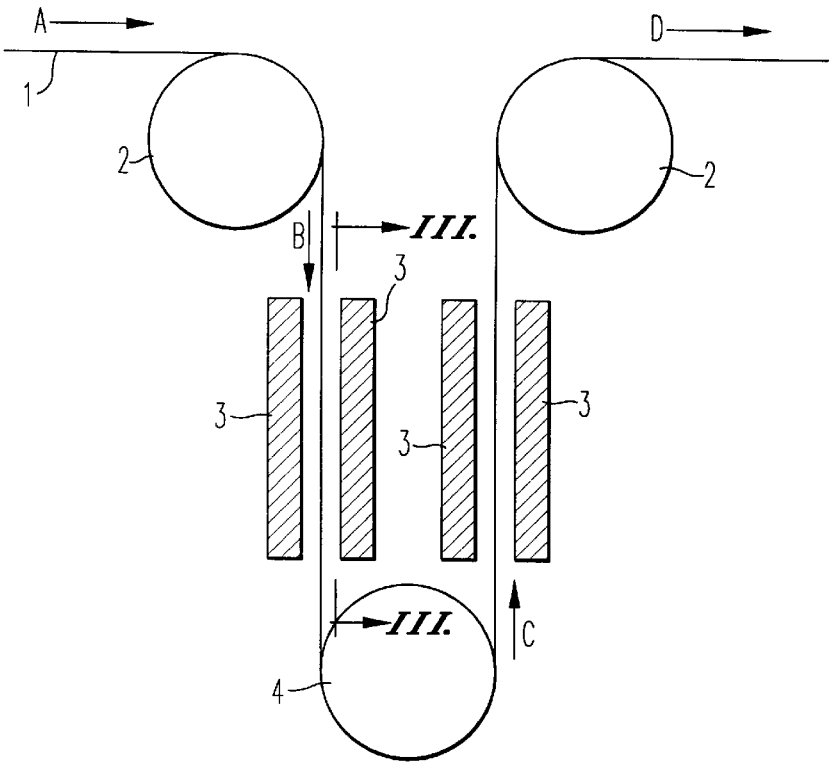
FIG. 1 is a schematic diagram of an embodiment of an electro-deposition apparatus according to the present invention.

FIG. 1 is a schematic diagram illustrating an embodiment of a electro-plating apparatus according to the present invention for electro-plating both sides of a metal strip 1. The apparatus includes a plurality of electrically conductive rollers 2 which are coupled to a terminal of a power source (not shown) and thus polarized to the charge of that terminal. In this embodiment, the rollers 2 are coupled to the cathode of the power source and thus negatively charged.

The apparatus further includes a plurality of panel casings 3 each comprising a polarized panel having sections 3A–3C (see FIG. 3) that are coupled to a terminal of the power source having a polarity opposite to the terminal to which the rollers 2 are coupled. Thus, the panel sections 3A–3C are polarized at a polarity opposite to the polarity of the rollers 2. In this embodiment, the panel sections 3A–3C are coupled to the anode of the power source and hence positively charged. Furthermore, as shown in FIG. 3, the panel casings 3 are positioned vertically or substantially vertically so that their panel sections 3A–3C are adjacent to each other in the horizontal direction and extend in a vertical or substantially vertical direction.

As further illustrated in FIG. 1, the panel casings 3 are arranged in pairs. The apparatus includes a deflection roller 4 which alters the direction in which the strip 1 is being conveyed so as to direct the strip from the first pair of panel casings 3 to the second pair of panel casings 3.

During an electro-deposition operation, the strip 1 is conveyed in a direction A to a first roller 2 where the strip 1 becomes polarized to the polarity of the first roller 2. In this embodiment, the strip 1 is therefore negatively polarized. The roller 2 directs the strip 1 in a direction B to pass through a space between a pair of panel casings 3 which, as described above, are polarized to a polarity (i.e., a positive polarity) opposite to that of the strip 1. An electrolytic liquid is emitted through at least one outlet in at least one of the panel sections 3A–3C in each of the panel casings in the pair, so that the strip 1 therefore becomes coated on both sides with the material present in the electrolytic liquid.

Figure 3:
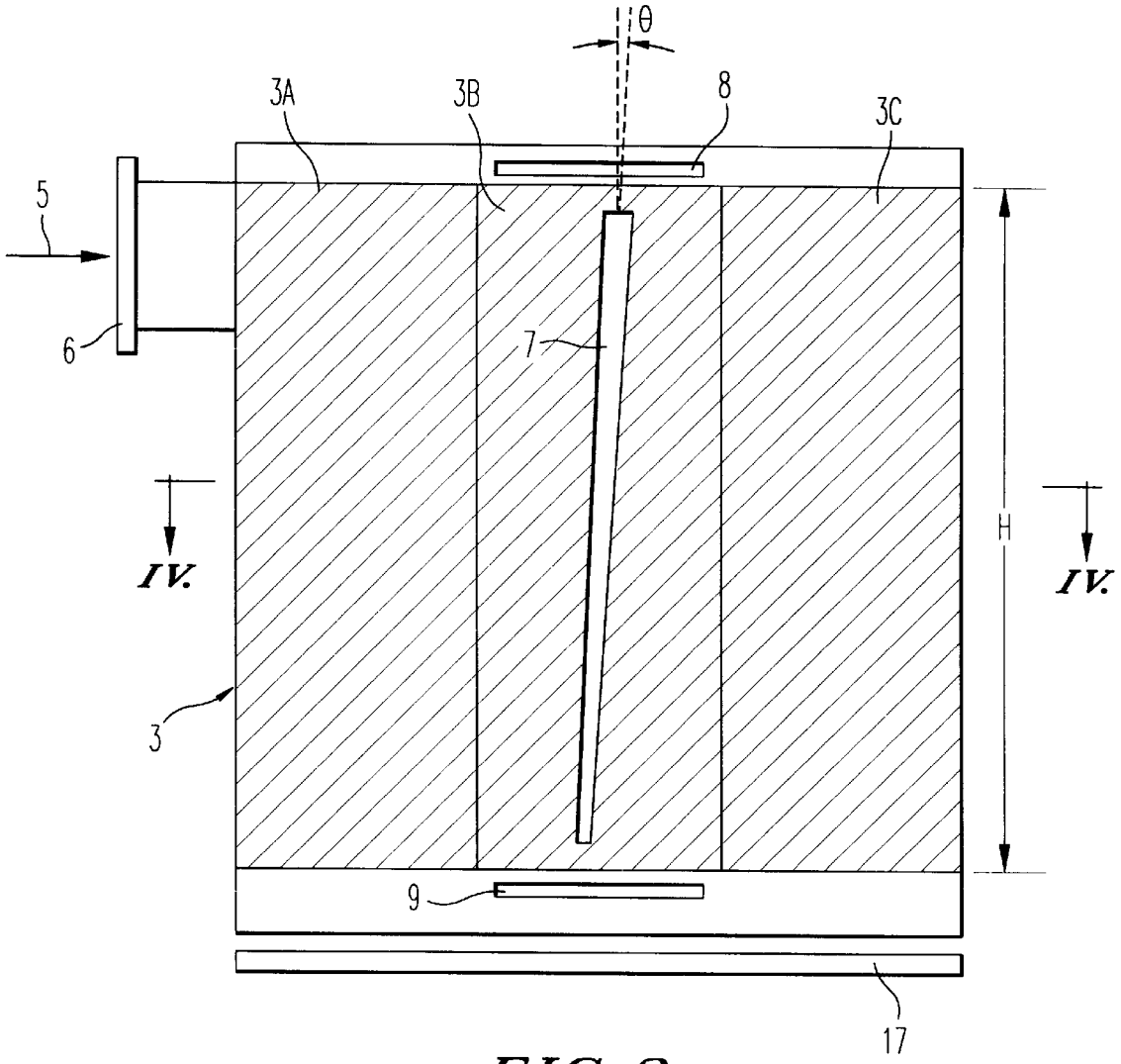
FIG. 3 is a view taken along lines III—III in FIG. 1 illustrating a polarized panel of the electro-deposition apparatus according to the present invention.

In particular, as shown in FIG. 3, middle panel 3B includes a slit 7 from which electrolytic liquid exits. The slit 7 extends in its lengthwise direction along the direction in which the strip 1 is being conveyed. The width of the slit can be uniform throughout the entire length of the slit 7, or preferably, can be tapered in the direction along which the strip is conveyed past the panel (i.e., from the top to bottom of the panel). Furthermore, the slit can extend in a direction parallel or essentially parallel to the direction in which the strip is conveyed past the panel. However, the slit preferably extends at an angle $\Theta$ with respect to the direction along which the strip is conveyed past the panel (i.e., at an angle with respect to the length of the panel). That angle $\Theta$ can be any suitable angle, and is preferably within a range of 10° to 15°.

After passing through the pair of panel casings 3, the strip 1 is conveyed over deflection roller 4 and is redirected to be conveyed in a direction C which is opposite or substantially opposite to direction B. The deflection roller 4 thus guides the strip 1 through the gap between the second pair of panel casings 3. The second pair of panel casings 3 function in a manner similar to the first pair of panel casings 3 to apply a further coat of material to both sides of the strip 1.

After passing through the second pair of panel casings 3, the strip 1 is conveyed over the second electrically conductive roller 2 which, as described above, is polarized at the same polarity as the first electrically conductive roller 2. The second roller 2 guides the strip 1 to be conveyed in a direction D.

As described above, the embodiment of the present invention shown in FIG. 1 can be used to coat or electroplate a metal strip 1 on both sides. The apparatus, of course, could also be used to coat a metal strip 1 on only one side if, for example, only one of the panel casings 3 is operated in the manner described above.

Figure 2:
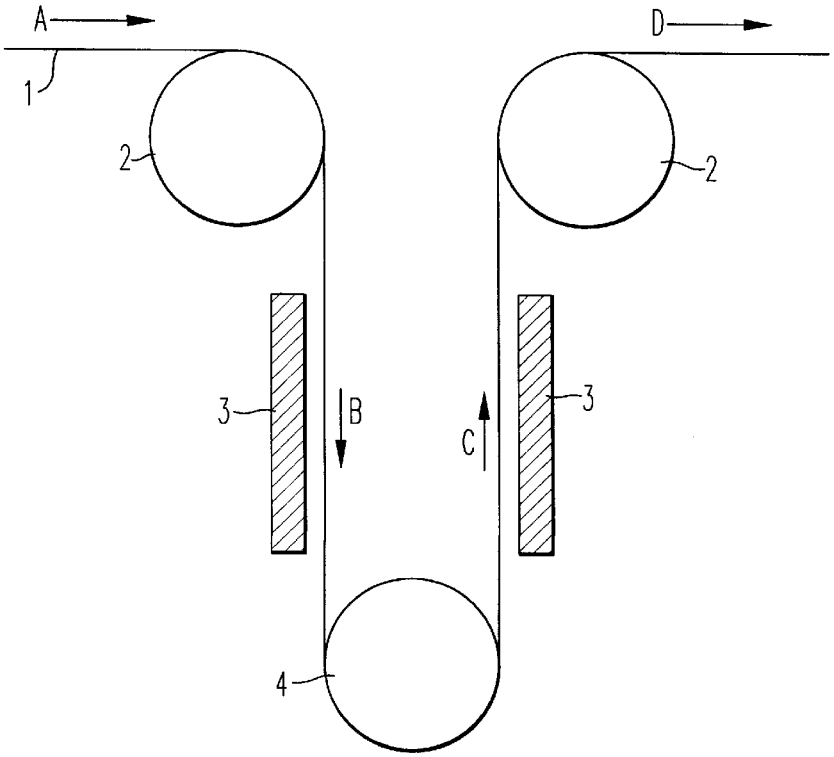
FIG. 2 is a schematic diagram of another embodiment of an electro-deposition apparatus according to the present invention.

However, as a practical matter, if the apparatus is used to coat only one side of a metal strip, two pairs of panel casings 3 are not necessary. Rather, as shown in FIG. 2, two single panel casings 3 can be arranged so that the coating is only applied to one side of the strip 1. The panel casings 3 are configured as the panel casings 3 in the first embodiment in that the each include a plurality of panel sections 3A–3C, as shown in FIG. 3, having at least one opening 7 through which electrolytic liquid can exit and thus come in contact with the side of the metal strip 1 to be coated.

FIG. 3 further illustrates additional features of the panel casing 3. As shown, the panel casing 3 includes three panel sections 3A–3C which are each coupled to a terminal of a power source (not shown) and thus polarized to a polarity opposite to the polarity at which the strip 1 is polarized by the rollers 2. The active portions of the panel sections 3A–3C, which are the portions of the panel sections that become polarized, each have a height as represented by "H". Of course, the panel of the panel casing 3 can be divided into any number of sections which may be needed to perform the electro-plating operation, and although it is preferable for the active portions of all the panel casings to have the same size, the size of the active portions can be different from each other.

The panel casing 3 includes an opening 5 and a connecting flange 6 into which an electrolytic liquid is fed. As described above, the panel casing 3 is oriented in a vertical or substantially vertical direction so that each of the panel sections 3A–3C likewise extend in a vertical or substantially vertical direction. The middle panel 3B includes a vertical or substantially vertical outlet slit 7 out of which the electrolytic liquid flows. Two horizontal or substantially horizontal slits 8 or 9 are present at the top and bottom, respectively, of the panel casing, and each extend essentially over the entire width of the middle panel B. The length of each of the slits 8 and 9 is set equal or substantially equal to the minimum width of the strip that is to be coated. By doing this, strips having a width equal to or larger than the minimum width can be coated with a minimal amount of electrolytic liquid being wasted.

Figure 4:
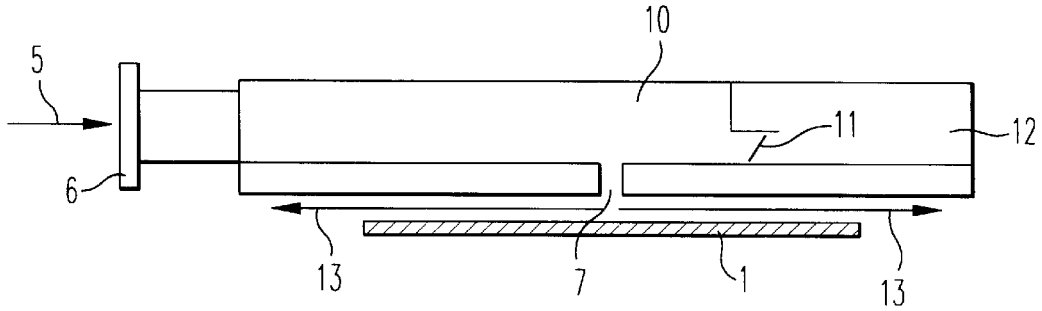
FIG. 4 is a cross-sectional view of the panel shown in FIG. 3 as taken along lines IV—IV.

A cross-sectional view of the panel casing 3 is illustrated in FIG. 4 as taken along the line IV—IV in FIG. 3. As shown, the electrolytic liquid enters casing 3 through opening 5 the connect flange 6 into a first section 10. The electrolytic liquid is therefore stored under pressure in the first section 10 of the panel casing. Slit 7 is in communication with the first section 10. The rate at which the electrolytic liquid is fed into the first section 10 is set in relation to the size of the outlet slit 7 so that the electrolytic liquid is stored in first section 10 at a pre-determined desired pressure. This pressure governs the rate and manner in which the liquid will flow through the slit 7 and thus affects the rate and manner in which the liquid will drain into the gap between the strip 1 and the panel 3 in the direction indicated by arrows 13.

Preferably, the pressure at which the liquid is maintained is selected so that the electrolytic liquid will flow out of the slit 7 in a direction essentially horizontal to the longitudinal edges of the strip 1. That is, the pressure is set so that the electrolytic liquid preferably will exit the slit 7 at a rate between 5 to 15 m/s, so that the rate at which the liquid flows between the strip 1 and panel 3 is maintained within the range of 1 and 5 m/s. As shown in FIG. 3, the panel casing 3 further includes a projecting portion which is a horizontal or essentially horizontal rail 17 which is mounted at the lower end of the panel casing 3 to assist in forming the horizontal flow of liquid in the gap between the strip 1 and the electro-plating panel sections 3A–3C of the panel casing 3.

The panel casing 3 further includes an adjustable control element 11 which provides communication between the first section 10 and a second unpressurized section 12 which is open to the atmosphere outside of the casing 3. In order to assist in maintaining the desired pressure in the first section 10, the portion of the electrolytic liquid that does not flow through slit 7 can flow into section 12 at a rate as controlled by the control element 11.

During operation, a portion of the electrolytic liquid flows out of first section 10 through the vertical slit 7 and fills the gap that is present between the panel sections 3A–3C and the strip 1 being conveyed past the panel sections 3A–3C. The remainder of the liquid flows through adjustable control element 11 into the unpressurized second section 12. Horizontal slits 8 and 9 are in communication with this second section 12. The electrolytic liquid in the second section 12 thus flows through horizontal slits 8 and 9 into the gap between the strip 1 and the panel sections 3A–3C. Hence, the electrolytic liquid will contact the side of the strip 1 which is to be coated by that particular panel casing 3, and the material in the liquid will adhere to the side of the strip being coated.

The use of the horizontal slits 8 and 9 is particularly advantageous because the electrolytic liquid will flow out of them to form a liquid curtain which prevents air from being sucked into the gap between the strip 1 and panel sections 3A–3C. However, the slits 8 and 9 need not be slits, but instead could have any desirable shape. That is, the slits 8 and 9 instead could be round holes, rhombuses, trapeziums, rectangles or any other type of geometrical shapes, or combinations of the above shapes. The number of slits 8 and 9 is also not limited to two, but rather, any number of openings could be present.

Figure 5:
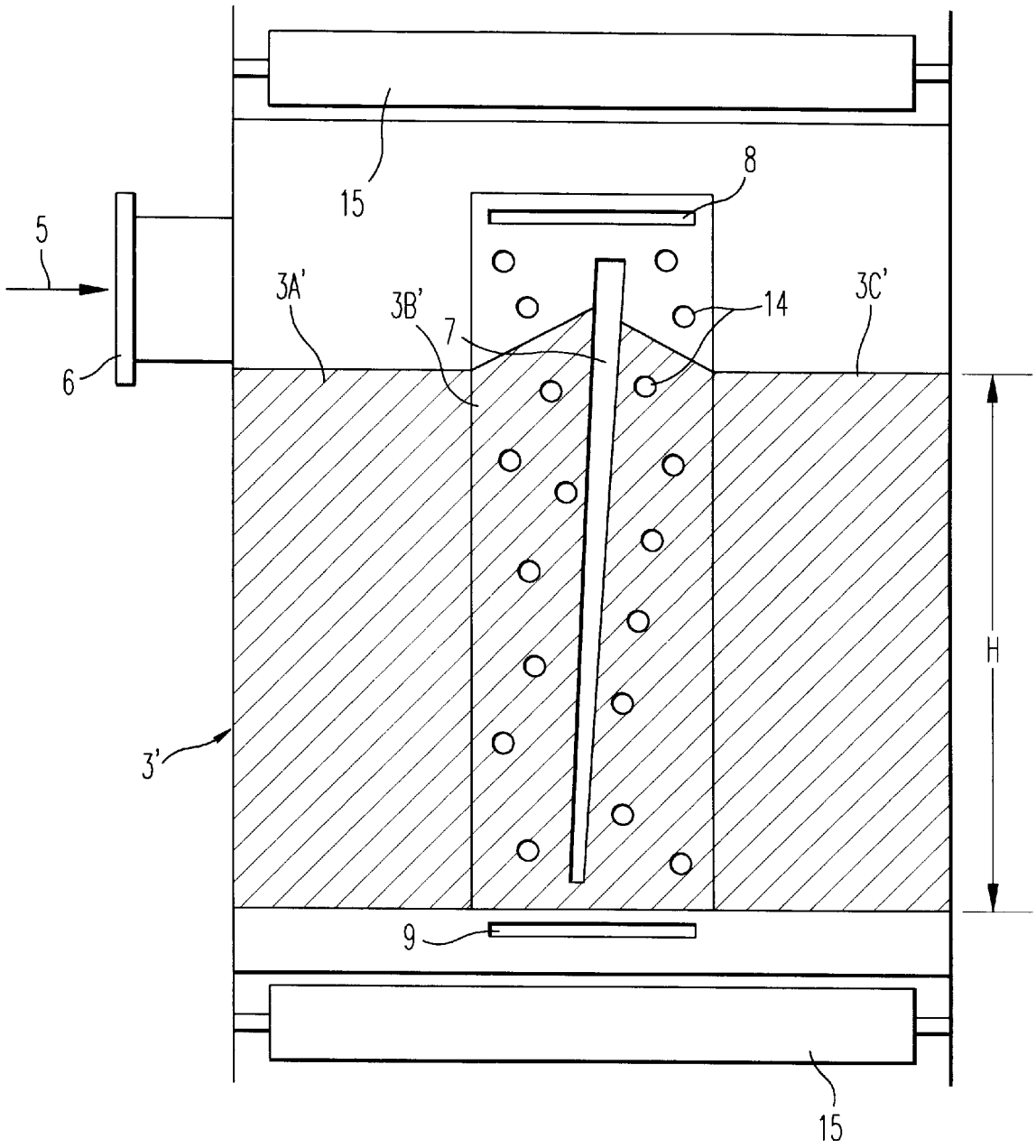
FIG. 5 illustrates another embodiment of the panel shown in FIG. 3.

FIG. 5 illustrates an alternate embodiment 3' of the panel casing shown in FIG. 3., which includes additional outlets 14 to stabilize the flow of the electrolytic liquid in the gap between the strip 1 and the anode casing 3'. Electrolytic liquid flows through these additional outlets 14 from the unpressurized section 12. The additional outlets 14 are preferably located in the middle panel section 3B', but can be present in any of the panel sections 3A'–3C'.

Also in this embodiment, supporting rollers 15 are disposed at the top and bottom side of the panel casing 3'. These supporting rollers 15 function to stabilize the path along which the strip 1 is conveyed past the panel and further, assist in maintaining the strip 1 at a precise distance from the panel so as to maintain the desired gap between the panel and strip 1. Furthermore, it is noted that the active portion of middle panel section 3B' is made longer than the active portion H of panel sections 3A' and 3C' to compensate for the surface area that is missing in the middle panel section 3B' due to the presence of the outlet slit 7 and additional outlets 12. In other words, the additional length give the middle panel section 3B" essentially the same active area as panel sections 3A' and 3C'.

Figure 6A:
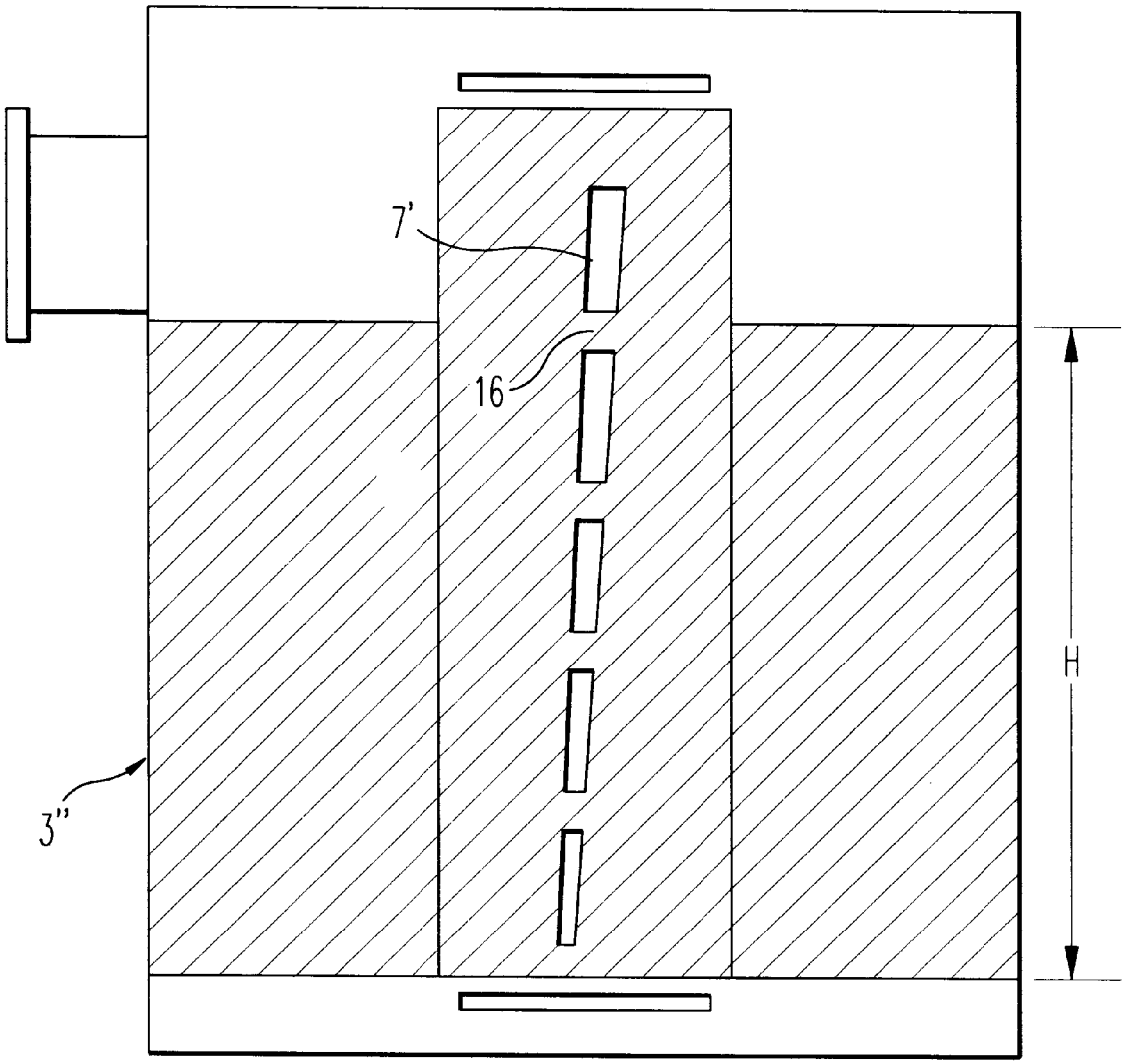
FIGS. 6A and 6B show further embodiments of the panel illustrated in FIG. 3.
Figure 6B:
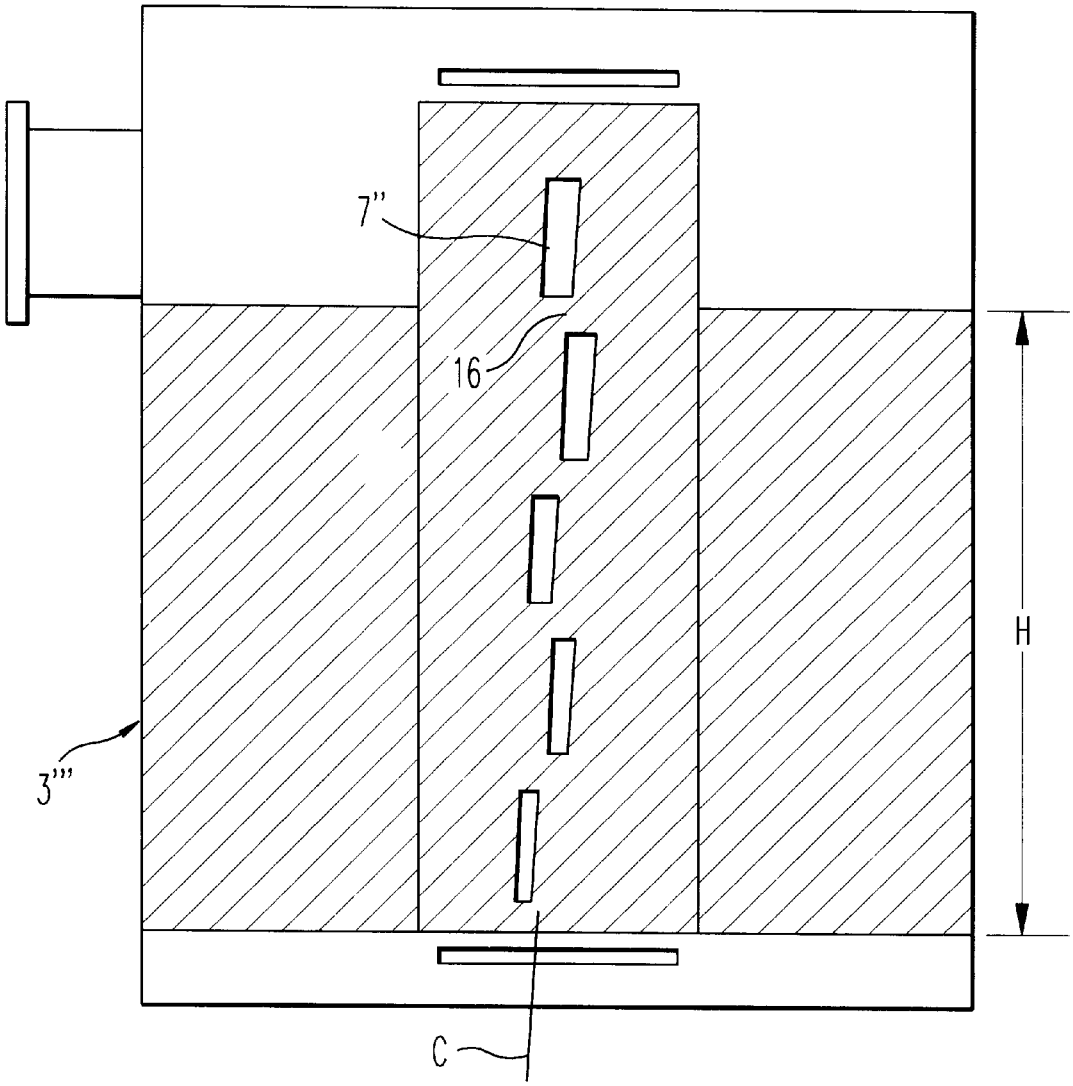

Another alternate embodiment of the panel casing configuration is shown in FIG. 6A. In this embodiment, the middle panel 3B" includes an outlet slit configuration 7' which is not a continuous slit, but rather, a plurality of slits 7A that are separated by cross-links 16. These cross-links 16 should preferably be between 20 and 200 mm long, and the length of the each of the plurality of slits 7A is preferably between 50 and 400 mm. Furthermore, as shown in FIG. 6B, some of the slits 7A could be arranged offset from a longitudinal center c of the slit configuration 7".

Of course, in this embodiment and the embodiments shown in FIGS. 3 and 5, the outlet slits 7, 7', 8 and 9, as well as the additional outlets 14, can have any practical size and shape based on the desired characteristics of the liquid flow as governed by known principles of fluid mechanics. For example, the edges of the slits and/or outlets can be rounded in the direction of outlet flow, and trumpet-like inlet parts can be used to provide communication between the slits, openings, etc. and their corresponding pressurized section 10 or unpressurized section 11 from which they receive the liquid. Also, the cross-links 16 can be streamlined instead of having straight edges. Furthermore, the panels in all of the embodiments should be insoluble in the electrolytic liquid, and can are preferably made of lead and lead alloys.

However, platinised metal or iridium oxide-coated titanium, which is particularly advantageous, can also be used, as well as any other type of suitable material. It is also advantageous for the edges of the slits, outlets and opening, as well as the cross-links, to be coated with such materials.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An apparatus for electro-depositing a material on at least one side of a metal strip that is conveyed past the apparatus, comprising:

at least one casing comprising:

a first container section, adapted to a store under pressure a liquid including the material;

a second container section in communication with the first container section and adapted to receive a portion of the liquid from the first container section and store the portion of the liquid unpressurized;

a panel comprising:

an active portion adapted to be electrically polarized at a first polarity;

at least one first outlet which is in communication with the first container section and which is adaptable to output at least a portion of the liquid stored under pressure in the first container section in a direction toward the metal strip when the metal strip is conveyed past the panel; and at least one second outlet which is in communication with the second container section and which is adaptable to output at least a portion of the liquid stored in the second container section in a direction toward the metal strip when the metal strip is conveyed past the panel; and an adjustable control element which control flow rate of the liquid between the first and second container sections to maintain a desired pressure in the first container section.

2. An apparatus according to claim 1, wherein the at least one first outlet includes a continuous slit whose length extends at an angle with respect to a direction in which the strip is conveyed past the panel.

3. An apparatus according to claim 2, wherein a width of the slit is tapered in the direction along which the strip is conveyed past the panel.

4. An apparatus according to claim 2, wherein the angle is within a range of 10° to 15°.

5. An apparatus according to claim 1, wherein the at least one first outlet is a slit configuration comprising a plurality of slit openings and a plurality of portions of the panel alternately arranged in succession along the direction in which the slit configuration extends.

6. An apparatus according to claim 5, wherein some of the slit openings are offset from a longitudinal center of the slit configuration.

7. An apparatus according to claim 1, wherein the at least one second outlet includes at least one opening having a length which extends in a direction traverse to the direction along which the strip is conveyed past the panel.

8. An apparatus according to claim 1, wherein:

the at least one first outlet is an opening whose length extends along a conveyance direction in which the strip is conveyed past the panel; and the at least one second outlet includes at least one opening having a length which extends in a direction traverse to the conveyance direction along which the strip is conveyed past the panel, and additional outlets which are disposed about the at least one first outlet.

9. An apparatus according to claim 1, wherein the casing further comprises a projecting portion which projects in a direction toward the strip when the strip is conveyed past the panel, and extends along the casing longitudinally in a direction traverse to the direction in which the strip is conveyed.

10. An apparatus according to claim 1, wherein the active portion of the panel comprises one of lead, lead alloy, platinised titanium and iridium oxide-coated titanium.

11. An apparatus according to claim 1, wherein the panel further comprises a non-active portion, and wherein at least one of the non-active portion and the casing comprises titanium and non-conducting, acid-resistant plastic.

12. An apparatus according to claim 1, further comprising at least one spacing roller that is coupled to the casing and is adapted to maintain the strip at a distance from the panel.

13. An apparatus according to claim 1, further comprising an adjustable mechanism that is adaptable to adjust a position of the panel with respect to a path through which the strip is conveyed.

14. An apparatus according to claim 1, further comprising a guiding mechanism, configured to guide the metal strip to travel past the at least one casing, and adapted to be electrically polarized at a second polarity opposite to the first polarity.

15. An apparatus according to claim 1, comprising two of said casings which are disposed so that their panels face each other at a distance from each other.

16. An apparatus according to claim 15, further comprising a guiding mechanism, configured to guide the metal strip to travel between the panels of the casings, and adapted to be electrically polarized at a second polarity opposite to the first polarity.

17. An apparatus according to claim 1, comprising two of said casings, and further comprising:

a first guiding mechanism, configured to guide the metal strip to travel past the panel of a first one of the casings so that a first side of the metal strip faces the panel of the first one of the casings, the first guiding mechanism being adapted to be electrically polarized at a second polarity opposite to the first polarity; and a second guiding mechanism, configured to guide the metal strip to travel past the panel of a second one of the casings so that a second side of the metal strip faces the panel of the second one of the casings.

18. An apparatus according to claim 1, comprising first and second pairs of said casings, each of the pairs of casings being configured so that the panels of the casings in one pair face each other at a distance from each other, the apparatus further comprising:

a first guiding mechanism, configured to guide the metal strip to travel between the panels of the first pair of casings, the first guiding mechanism being adapted to be electrically polarized at a second polarity opposite to the first polarity; and a second guiding mechanism, configured to guide the metal strip to travel between the panels of the second pair of casings.

19. An apparatus for electro-depositing a material on at least one side of a metal strip that is conveyed past the apparatus, comprising:

at least one casing comprising:

a first container section, adapted to store under pressure a liquid including the material;

a second container section in communication with the first container section and adapted to receive a portion of the liquid from the first container section and store the portion of the liquid unpressurized; and a panel comprising:

an active portion adapted to be electrically polarized at a first polarity;

at least one first outlet which is in communication with the first container section and which is adaptable to output at least a portion of the liquid stored under pressure in the first container section in a direction toward the metal strip when the metal strip is conveyed past the panel; and at least one second outlet which is in communication with the second container section and which is adaptable to output at least a portion of the liquid stored in the second container section in a direction toward the metal strip when the metal strip is conveyed past the panel; and wherein the panel is divided into a plurality of sections which are adjacent to each other in a direction transverse to the direction in which the strip is conveyed past the panel, and wherein the at least one first and second outlets are disposed in the section which is in a middle of the panel.

20. An apparatus according to claim 19, wherein each of the sections of the panel includes an active portion which is a portion of the active portion of the panel, and at least one of the following conditions is met:

the middle section of the panel is longer than any of the other sections in the direction in which the strip is conveyed past the panel; and each of the active portions includes a surface area, the surface area of the active portions of all of the sections of the panel being substantially equal to each other.

21. A method for electro-depositing a material on at least one side of a metal strip that is conveyed past at least one casing comprising first and second container sections and a panel having at least one first outlet therein and at least one second outlet therein, comprising the steps of:

storing under pressure a liquid including the material in the first container section;

passing a portion of the liquid stored in the first container section into the second container section, and storing the portion of the liquid unpressurized in the second container section;

conveying the metal strip past the panel;

ejecting under pressure the liquid stored in the first container section through the at least one first outlet in a direction toward the strip;

ejecting the portion of the liquid stored in the second container section through the at least one second outlet in a direction toward the strip; and adjustably controlling flow rate of the liquid between the first and second container sections to maintain a desired pressure in the first container section.

22. A method as claimed in claim 21, further comprising the step of:

adjusting a position of the panel with respect to a path through which the strip is conveyed.

23. A method as claimed in claim 21, further comprising the steps of:

electrically polarizing the panel at a first polarity; and guiding the metal strip to travel past the panel which electrically polarizing the metal strip at a second polarity opposite to the first polarity.

24. A method as claimed in claim 21, wherein the metal strip is conveyed past two of said casings which are disposed so that their panels face each other at a distance from each other, and wherein the method further comprises the steps of:

electrically polarizing the panels at a first polarity; and guiding the metal strip to travel between the panels while electrically polarizing the metal strip at a second polarity opposite to the first polarity.

25. A method as claimed in claim 21, further comprising the steps of:

disposing two of said casings at locations to be passed by the metal strip;

electrically polarizing the panels of the casings at a first polarity;

guiding the metal strip to travel past the panel of a first one of the casings so that a first side of the metal strip faces the panel of the first one of the casings, while electrically polarizing the metal strip at a second polarity opposite to the first polarity; and guiding the metal strip to travel past the panel of a second one of the casings so that a second side of the metal strip faces the panel of the second one of the casings.

26. A method as claimed in claim 21, further comprising the steps of:

arranging first and second pairs of said casings such that each of the pairs of casings are configured so that the panels of the casings in one pair face each other;

electrically polarizing the panels of the casings at a first polarity;

guiding the metal strip to travel between the panels of the first pair of casings while electrically polarizing the metal strip at a second polarity opposite to the first polarity; and guiding the metal strip to travel between the panels of the second pair of casings.

27. A method as claimed in claim 21, wherein:

a flow control element provides fluid communication between the first and second container sections; and the flow controlling step controls the flow control element to adjust the rate of flow of the liquid between the first and second container sections.

28. An apparatus for electro-depositing a material on at least one side of a metal strip that is conveyed past the apparatus, comprising:

at least one casing comprising:

a first container section, adapted to store under pressure a liquid including the material;

a second container section in communication with the first container section and adapted to receive a portion of the liquid from the first container section and store the portion of the liquid unpressurized; and a panel comprising:

an active portion adapted to be electrically polarized at a first polarity;

at least one first outlet which is in direct communication with the first container section without communicating with the second container section, and which is adaptable to output at least a portion of the liquid stored under pressure in the first container section in a direction toward the metal strip when the metal strip is conveyed past the panel; and at least one second outlet which is in direct communication with the second container section without communicating with the first container section, and which is adaptable to output at least a portion of the liquid stored in the second container section in a direction toward the metal strip when the metal strip is conveyed past the panel.

29. A method for electro-depositing a material on at least one side of a metal strip that is conveyed past at least one casing comprising first and second container sections and a panel having at least one first outlet therein in communication with the first container section and at least one second outlet therein in communication with the second container section, comprising the steps of:

storing under pressure a liquid including the material in the first container section;

passing a portion of the liquid stored in the first container section into the second container section, and storing the portion of the liquid unpressurized in the second container section;

conveying the metal strip past the panel;

ejecting under pressure the liquid stored in the first container section through the at least one first outlet without passing through the second container section in a direction toward the strip; and ejecting the portion of the liquid stored in the second container section through the at least one second outlet without passing through the first container section in a direction toward the strip.

* * * * *